US006247874B1

(12) United States Patent
Hu

(10) Patent No.: US 6,247,874 B1
(45) Date of Patent: Jun. 19, 2001

(54) DRAINAGE AND STRAP DRAIN MATERIALS

(76) Inventor: Ming-Chun Hu, No. 3-503, Twelfth Road, New Garden Community Hsin Tien City Taipei (TW)

( * ) Notice: Subject to any disclaimer, the term of this patent is extended or adjusted under 35 U.S.C. 154(b) by 0 days.

(21) Appl. No.: 09/455,399

(22) Filed: Dec. 6, 1999

(30) Foreign Application Priority Data

Feb. 9, 1999 (TW) ..... 86101268 A01

(51) Int. Cl.[7] ..... E02B 11/00

(52) U.S. Cl. ..... 405/43; 405/45; 405/36; 52/169.5; 52/169.14

(58) Field of Search ..... 405/50, 45, 44, 405/39, 36; 52/169.5, 169.14

(56) References Cited

U.S. PATENT DOCUMENTS

| | | | | |
|---|---|---|---|---|
| 5,056,281 | * | 10/1991 | McCarthy | 52/169.5 |
| 5,369,926 | * | 12/1994 | Borland | 52/302.1 |
| 5,511,346 | * | 4/1996 | Kenworthy | 52/169.5 |
| 5,704,172 | * | 1/1998 | Gougeon et al. | 52/169.5 |
| 5,934,828 | | 8/1999 | Hu et al. . | |

* cited by examiner

*Primary Examiner*—David Bagnell
*Assistant Examiner*—Frederick L. Lagman
(74) *Attorney, Agent, or Firm*—Burns, Doane, Swecker & Mathis, L.L.P.

(57) ABSTRACT

A strap drain material adapted for use in soil conservation in the hillside regions, in subterranean drainage for orchards and farmlands and in drainage system of the tunnels, road basement and basement of the buildings is formed on one surface of the flexible strap like or panel like body with a plurality of drainage grooves arranged parallel densely spaced-apart along the direction of the width and extending whole length along the direction of the length and including slit like openings capable of producing capillary action and interior channels expanding to form rounded holes. By the difference in water level at the two ends of the channels or the syphonic force so produced the capacity to absorb water is increased and water is collected and drained away. The interior of the part of the drain material where there is without drainage grooves is embedded with a plurality of longitudinally parallel arranged reinforcements of metal filament, synthetic filament or of crisscross network formed thereof. Also, on the two sides of the drain materials each is formed with a lap-joint part to provide for the adjoining drain materials to be connected in lap-joint manner and which has similar shape and is opposite in direction.

13 Claims, 3 Drawing Sheets

DRAINAGE AND STRAP DRAIN MATERIALS

BACKGROUND OF THE INVENTION

The present invention relates to drainage and, in particular, to improvements in the drainage method and the strap drain materials therefor.

The inventor discloses in the U.S. Pat. No. 5,934,828 a drainage method and strap drain materials adapted for use in the soil conservation on mountain slopes, the underground drainage on orchards and farms, and the drainage system in tunnels, road bases and building basements. This is brought about at the openings of drain channels of the materials by means of capillary action to absorb in water from the soil, by the difference in elevation between the two ends inside the channels of enlarged area and the partial siphoning force so produced thereby promoting water absorption and collection for discharge. Samples of such materials on testing have now been found to contain the following problems, which need to be improved:

(1) because the drain materials are of a sheet like strap type, the hollow portion in section occupies a considerable area, which more often exceeds that of the solid portion. On production, due to small resistance to pulling, the materials sometimes break on pulling or the channels are deformed and are therefore not suitable for high speed long measure continuous production. On use, because of relatively small strength of the pull resisting structure, the entire strap is easily pulled crack.

(2) It is very difficult when the drain materials have to be connected laterally. Also, by means of connecting it is inconvenient and unreliable by means of connecting members affecting the construction works. Furthermore, when embedded in soil it also produces relative slip easily because of the small frictional ground gripping force of the soil.

SUMMARY OF THE INVENTION

Because of the foregoing shortcomings, the inventor continued to improve and have thereby accomplished in the completion of the invention. Accordingly, it is an object of the present invention to provide a strap drain material having an even larger tensile strength and ground gripping force as well as excellent operativeness in side by side connection.

Another object of the invention is to provide a strap drain material capable of being vertically deeply embedded or buried in hillside where no trees are planted or where after trees are felled there is no water conserving action by trees and, by means of its excellent ability to absorb and direct water, capable of conducting rainwater rapid-and-effectively deep into the soil whereby washing down of a large amount of rainwater is prevented.

A further object of the invention is to provide a strap drain material having a high tensile strength to be suitable for continuous mass production.

In order to accomplish the above purposes, a strap drain material of the present invention is provided where inside the strap body on one side of the strap body having drainage channels, there is embedded a plurality of parallel, side-by-side arranged filaments or synthetic fiber filaments or tensile reinforcements formed by horizontal and vertical interleaving or interlocking of the filaments into a net form and formed integrally with the strap body. Next, on the side of the strap body where there are no drainage channels, depending on the necessity a plurality of straight or curve line cross ribs or continuously curved line ribs may be formed integrally with the strap body to increase the frictional force (earth gripping force) in relation to the soil and may also act to enhance the strength of the strap body. Furthermore, on the two lateral sides of the strap body are formed with lap joint parts to provide for the adjoining drain materials to lap over each other.

BRIEF DESCRIPTION OF THE DRAWINGS

Other objects, features and advantages of the invention will be apparent from the following more particular description of a preferred embodiment of the invention, as illustrated in the accompanying drawings.

DETAILED DESCRIPTION OF THE PREFERRED EMBODIMENT

Figure 1:
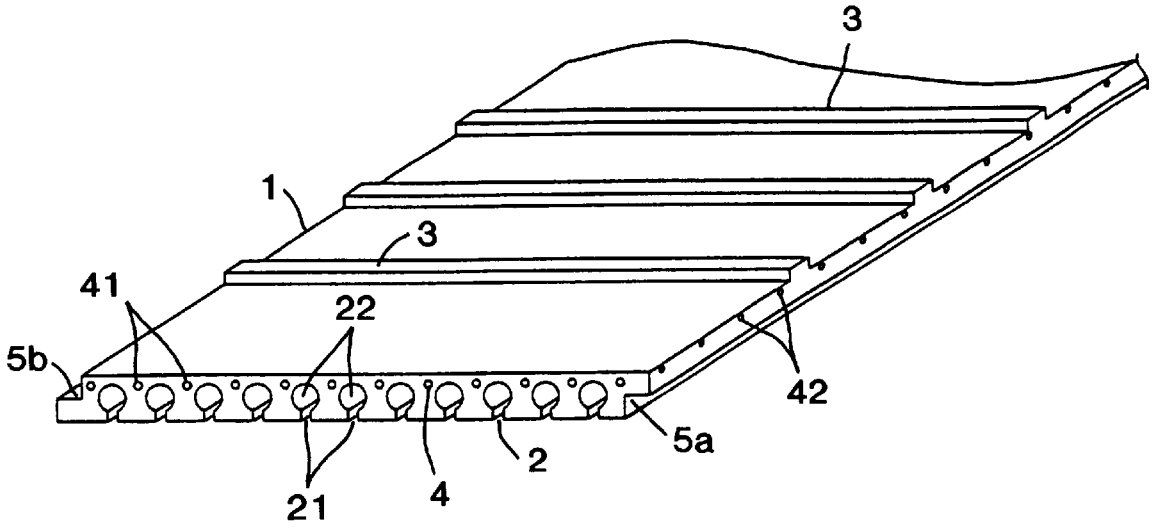
FIG. 1 is a partial perspective view of a drain material of the present invention.

In FIG. 1, symbol 1 is a flat strap drain material generally made of a flexible strap material formed by weather-proof, acid alkali resistant synthetic resins. However, depending on the necessity of use, a plate formed of a semi-hard or hard synthetic resin may also be used. The strap drain material is formed densely packed on one side thereof with a plurality of drainage grooves 2 arranged spaced-apart along the transverse direction and running parallel along the longitudinal direction to pass through and extend from one end to the other end. Openings 21 of the grooves 2 are formed with narrow slits capable of producing a capillary action. Channels 22, on the other hand, are expanded to be of round-hole shape in cross section. On the other side of the drain material 1 there is integrally formed a plurality of cross ribs 3 arranged spaced-apart along longitudinal direction and protruding out upwardly to make possible an increase in the frictional and earth gripping forces a the soil When the drain material 1 is embedded in the soil and to avoid slide of the soil facing surface, Inside the drain material 1, in the solid body part thereof; where no drainage grooves 2 are provided, there are embedded with reinforcements 4 for increasing the tensile strength of strap body of the drain material 1. Furthermore, in order to facilitate transverse connection of the drain materials 1 so that the width of the material can be increased, there are formed on the two lateral sides of the drain material 1 male and female lap joint parts 5*a*, 5*b* connected together in lap joint of the adjoining drain materials 1.

Figure 2:
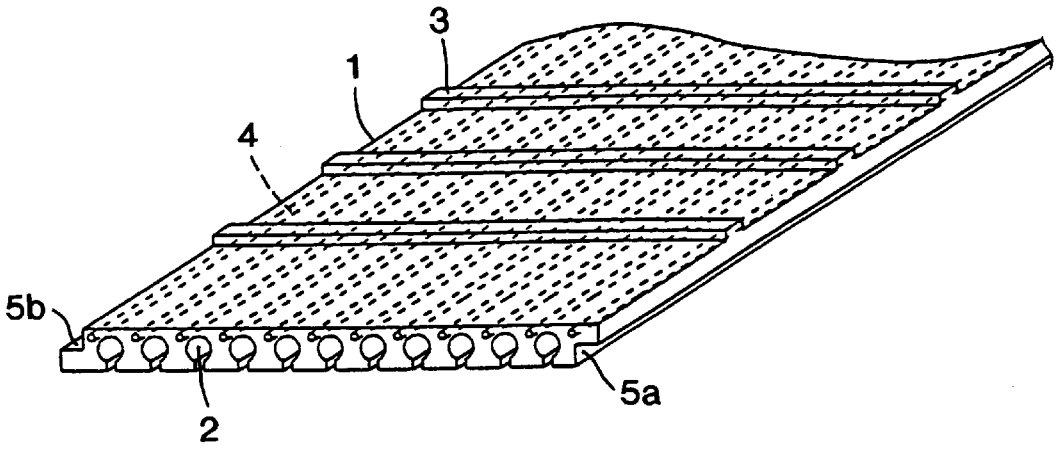
FIG. 2 is a schematic view of one embodiment of the drain material of the invention having only longitudinal tensile reinforcements.
Figure 3:
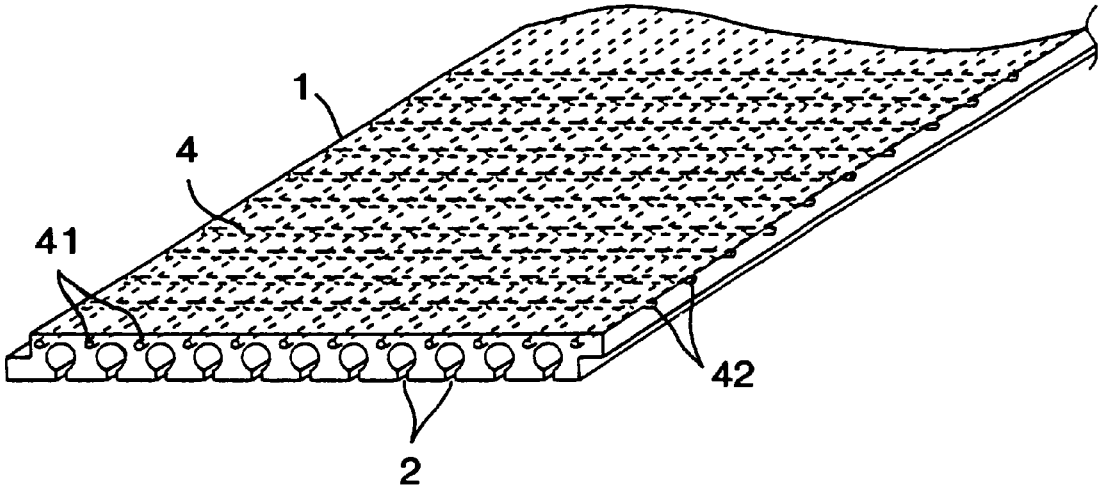
FIG. 3 is a schematic view of one embodiment of the drain material of the invention having longitudinally and transversely staggered net-shaped reinforcements.

The above described tensile reinforcements 4 can be reinforcing materials formed, as show in FIG. 2, from a plurality of metal filaments 41 such as for example: steel filaments, arranged preferably parallel in equispaced apart fashion along lengthwise direction to pass though the strap body 1, or the tensile reinforcements can also be net like reinforcing materials formed, as shown in FIG. 3, from a plurality of longitudinal and horizontal metal filaments 41, 42, such as for example: steel filaments, in horizontal and vertical stagger or interleaving fashion. The longitudinal and the horizontal steel filaments 41 and 42, which constitute the net like reinforcing materials 4, are capable of being vertically staggered and overlapped, and welded to form a single body by point welding. For convenience in the forming, the steel filaments 41 and 42 can also be interleaved with each others to form a net and thereafter welded by point welding as a single body. It is also possible if instead punch metal gauze sheets or punch, shear, pull, break type metal gauze are used. In addition, reinforcing materials 4 may be made of non-metallic material, such as synthetic fiber filaments like high strength nylon filaments or gauze material formed by weaving of synthetic fiber filaments.

Figure 4:
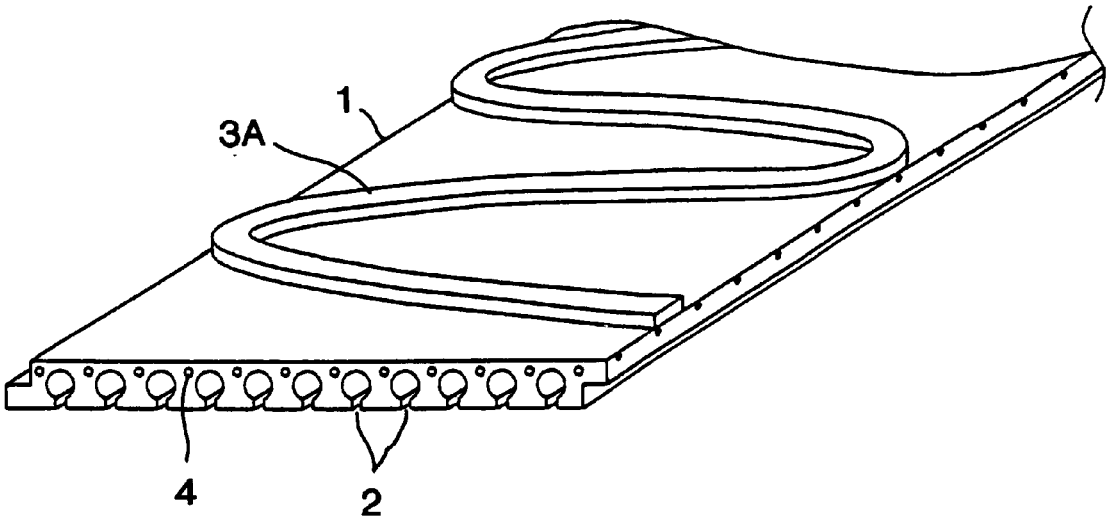
FIG. 4 is a perspective view of one embodiment of the drain material of the invention having curved ribs.

In the embodiment shown in FIG. 1, the ribs 3 formed on one surface of the drain material 1, where no drainage groove 2 is provided, are the equispacedly arranged transverse ribs 3, by means of which these ribs 3 allow the drain material 1, when embedded in the earth, to increase its longitudinal frictional earth-gripping force on its contacting the soil in order to prevent any sliding of soil. The embodiment shown in FIG. 4 shows the shape of a rib 3, which forms a continuous curve rib 3A twisting and extending along the longitudinal direction. In this way, it also makes possible to increase the longitudinal and the transverse earth-gripping forces simultaneously. It evident that ribs are not limited to the above two makeups; if need be, different shapes may be formed in accordance with design, for instance, multi-curve or waveform ribs formed from the above mentioned transverse ribs 3, or to form a crisscross network of mesh shape of the ribs, or to form intermittent curve ribs or even ribs formed by a mixture of straight lines and curve lines, and all these variant examples will not be shown separately herein. It is to be noted here that functions of the ribs 3 and the reinforcement materials and the forming longitudinal ribs disclosed in the U.S. Pat. No. 5,934,828 are not quite the same.

Figure 5:
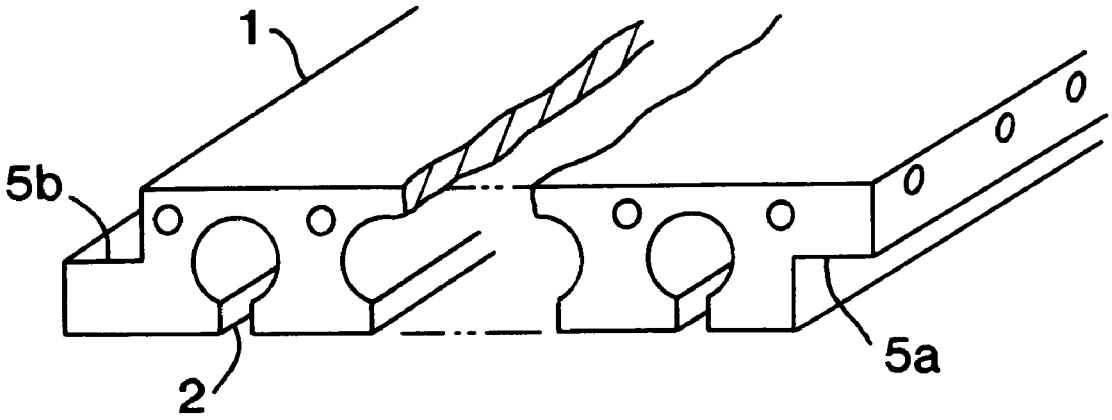
FIG. 5 is an enlarged perspective view of the lap parts of the drain material of the invention.
Figure 6:
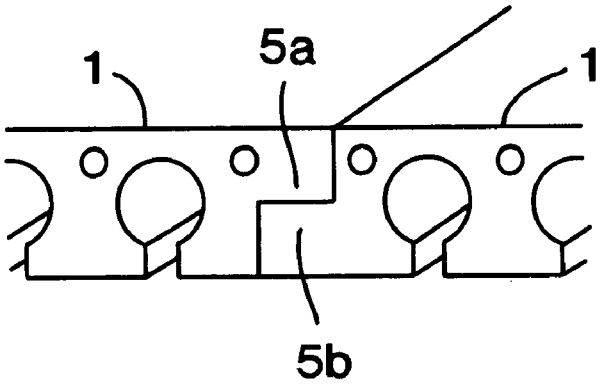
FIG. 6 is a perspective view of the essential parts of the drain material of the invention in a state where lap parts are joined together in lap over fashion.

As shown in the enlarged view of FIG. 5, the lap joint parts 5*a*, 5*b* on the two sides of the drain material 1 comprise the stepwise lap joint part 5*a* having the notch on the right hand side of the drawing facing downwardly and the step lap joint part 5*b* having the notch on the left hand side thereof facing upwardly. Substantially, the two lap joint parts 5*a*, 5*b* are formed into a paired matching configuration with identical shape but of an opposite direction, whereby adjoining drain materials 1 are laterally lapped over closely and glued together to form a single body as shown in FIG. 6. Thus, depending on construction necessity, the drain materials may be joined laterally to increase the width.

Having a configuration as above, the drain materials of the present invention possess, in addition to having an excellent drainage function and result, a best tensile strength to be suitable for high speed and long length continuous production, and also raise the pull resisting force and loading capacity in the construction work thereby extending the service life. Those of the drain material, where on one side thereof reinforcements are provided, possess even more earth gripping force against the soil and can prevent any slide of soil on the contact side. Whereas for those of the drain material, where lap joint parts are provided on the two sides thereof, the advantage is that several sheets of the drain material may be connected laterally together.

Furthermore, the drain materials according to the present invention, if vertically dispersedly implanted in the slope of the mountain where there are no trees to conserve water and whereby the upper ends cover slightly on the earth surface or are flush with the ground, by their originally possessed excellent water absorption and water conducting capabilities are able to conduct rain water quickly and effectively into the deeper layers of the soil for conservation during heavy rain. It is therefore possible to effectively prevent rain water from bursting down quickly in large quantities in a flood and also at times when it is hot and dry to recover the lower layer water so conserved in the soil for re-use. The drain materials according to the invention thus possess a surprisingly hillside soil conservation function, which is hitherto undisclosed in the prior art and should be taken as another novel use.

While preferred embodiments of the invention have been shown and described, it will be apparent to those skilled in the art that changes can be made in this embodiment without departing from the principles and spirit of the invention, the scope of which is defined in the appended claims.

What is claimed is:

1. A strap drain material comprising:

a flexible panel-like strap body made of weather-proof synthetic resin material;

drainage grooves formed on one surface of the strap body and arranged in parallel and being spaced-apart along a width direction of the strap body and extending a whole length openings of narrow slits of the strap body, the drainage grooves each including a slit-shaped opening narrow enough to produce capillary action and expanded round-hole shaped interior channels extending from the openings into an interior of the strap body, wherein the openings cause surrounding water to be absorbed into the channels by capillary action and, when the strap body is arranged so that there is a drop in elevation between ends of channels, the absorbed water is urged to collect and drain away; and longitudinal reinforcements for resisting tension stresses in the strap body embedded in a solid interior portion of the strap body.

2. A strap drain material according to claim 1, wherein the reinforcements include a plurality of filament materials of at least one of metal filament and synthetic fiber filament.

3. A strap drain material according to claim 1, wherein the reinforcements include a network of filament materials including a plurality of filament materials arranged along the length and width of the strap body.

4. A strap drain material according to claim 1, wherein one surface of the strap body is without drainage grooves and is provided with reinforcing ribs formed integrally with the strap body for increasing a frictional earth-gripping force against soil.

5. A strap drain material according to claim 1, wherein the strap body includes two lateral sides, a first one of the two sides being provided with a male lap-joint and a second one of the two sides being provided with a female lap-joint part such that adjoining drain materials are adapted to be connected to each other in a lap joint.

6. A strap drain material according to claim 5, wherein adjacent strap drain materials are adapted to be joined together by glue at the lap joint.

7. A method for conserving soil in hillsides, comprising;

distributing one or more strap drain materials along a surface of a hillside, each of the one or more strap drain materials including a flexible panel-like strap body made of weather-proof synthetic resin material, drainage grooves formed on one surface of the strap body and arranged in parallel and being spaced-apart along a width direction of the strap body and extending a whole length of the strap body, the drainage grooves each including a slit-shaped opening narrow enough to produce capillary action and expanded round-hole shaped interior channels extending from the openings into an interior of the strap body, wherein the openings cause surrounding water to be absorbed into the channels by capillary action and, when the strap body is arranged so that there is a drop in elevation between ends of channels, the absorbed water is urged to collect and drain away, and longitudinal reinforcements for resisting tension stresses in the strap body embedded in a solid interior portion of the strap body; and embedding portions of the one or more strap drain materials vertically in soil on the hillside so that upper ends of the one or more strap drain materials are exposed on a surface of the soil; and conducting water washing over the surface into a deeper layer of the soil for storage through the drainage grooves.

8. A strap drain material comprising:

a flexible panel-like strap body made of weather-proof synthetic resin material;

drainage grooves formed on one surface of the strap body and arranged in parallel and being spaced-apart along a width direction of the strap body and extending a whole length of the strap body, the drainage grooves each including a slit-shaped opening narrow enough to produce capillary action and expanded round-hole shaped interior channels extending from the openings into an interior of the strap body, wherein the openings cause surrounding water to be absorbed into the channels by capillary action and siphonic action urges the absorbed water to collect and drain away; and longitudinal reinforcements for resisting tension stresses in the strap body embedded in a solid interior portion of the strap body.

9. A strap drain material according to claim 8, wherein the reinforcements include a plurality of filament materials of at least one of metal filament and synthetic fiber filament.

10. A strap drain material according to claim 8, wherein the reinforcements include a network of filament materials including a plurality of filament materials arranged along the length and width of the strap body.

11. A strap drain material according to claim 8, wherein one surface of the strap body is without drainage grooves and is provided with reinforcing ribs formed integrally with the strap body for increasing a frictional earth-gripping force against soil.

12. A strap drain material according to claim 8, wherein the strap body includes two lateral sides, a first one of the two sides being provided with a male lap-joint and a second one of the two sides being provided with a female lap-joint part such that adjoining drain materials are adapted to be connected to each other in a lap joint.

13. A strap drain material according to claim 12, wherein adjacent strap drain materials are adapted to be joined together by glue at the lap joint.

* * * * *